US011282316B2

(12) United States Patent
Amuduri et al.

(10) Patent No.: US 11,282,316 B2
(45) Date of Patent: Mar. 22, 2022

(54) CONTAINER AND ASSOCIATED METHODS

(71) Applicant: Carrier Corporation, Palm Beach Gardens, FL (US)

(72) Inventors: Santhosh Amuduri, Telangana (IN); Adam Kuenzi, Salem, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/992,645

(22) Filed: Aug. 13, 2020

(65) Prior Publication Data

US 2021/0056789 A1 Feb. 25, 2021

(30) Foreign Application Priority Data

Aug. 23, 2019 (IN) ..... 201911034055

(51) Int. Cl.
*G08B 13/22* (2006.01)
*G07C 9/00* (2020.01)

(52) U.S. Cl.
CPC ..... *G07C 9/00896* (2013.01); *G08B 13/22* (2013.01); *G07C 2009/00936* (2013.01); *G07C 2009/00984* (2013.01)

(58) Field of Classification Search
CPC ..... G01S 5/04; G01S 5/06; G01S 5/12; G01S 11/06; G01S 3/46; G01S 3/50; G01S 5/0242; G01S 5/0289; G01S 5/08; G01S 5/14; G01S 3/043; G01S 3/14; G01S 3/74; G01S 5/0247; G01S 5/0284; G01S 11/04; G01S 1/02; G01S 1/08; G01S 2205/01; G01S 3/023; G01S 5/0221; G01S 5/0273; G01S 5/0294; G01S 13/767; G01S 13/82; G01S 13/878; G01S 19/51; G01S 1/042; G01S 1/0426; G01S 2205/09; G01S 2205/10; G01S 3/48; G01S 5/00; G01S 5/0036; G01S 5/021; G01S 5/0236; G01S 5/0252; H04W 4/02; H04W 4/023; H04W 4/33; H04W 4/30; H04W 4/80; H04W 64/00; H04W 64/006; H04W 16/28; H04W 40/06; H04W 48/08; H04W 4/029; H04W 4/48; H04W 56/002; H04W 84/12; H04W 84/18; H04W 88/10; H04W 12/08; H04W 12/12; H04W 12/63; H04W 8/22; H04W 4/021; H04W 4/026; H04W 4/027;

(Continued)

(56) References Cited

U.S. PATENT DOCUMENTS 9,618,600 B2 4/2017 Desai et al.
9,723,588 B1 8/2017 Urrutia et al.

(Continued)

FOREIGN PATENT DOCUMENTS

CN 109466505 A 3/2019
EP 3147868 A1 3/2017

(Continued)

*Primary Examiner* — Dionne Pendleton
(74) *Attorney, Agent, or Firm* — Cantor Colburn LLP

(57) ABSTRACT

A container comprising a communication module adapted to receive a first signal from a fob coupled to an item; and a measurement module, coupled with the communication module, the measurement module adapted to measure a first angle-of-arrival based on the first signal received from the fob, and determine if the first angle of arrival is within a first pre-defined threshold range.

14 Claims, 5 Drawing Sheets

(58) Field of Classification Search
CPC ... H04W 4/38; H04W 52/0203; H04W 84/20; H04W 8/005; G07C 2209/63; G07C 2009/00769; G07C 2009/00793; G07C 2009/00936; G07C 2009/00984; G07C 9/00309; G07C 9/00896; G07C 9/00912; H04L 27/22; H04L 67/02; H04L 67/12; H04L 67/18; H04L 67/20; H01Q 11/08; H01Q 1/3275; H01Q 1/38; H01Q 21/0006; H01Q 21/08; H01Q 21/22; H01Q 21/24; H04B 7/26; H04B 1/0007; H04M 1/72412; G06K 7/10297; G06K 19/06; G06K 7/0008; G06K 7/10366; G06K 7/10465; G06Q 10/083; G06Q 10/0833; G06Q 10/00; G06Q 10/08; G06Q 10/087; G06Q 20/203; G06Q 30/0261; G06Q 30/06; G06Q 50/28; G06F 3/0481; G07G 1/009; H04Q 2209/47; H04Q 2209/84; Y02D 30/70
See application file for complete search history.

(56) References Cited

U.S. PATENT DOCUMENTS

| | | | | |
|---|---|---|---|---|
| 10,104,499 | B2 * | 10/2018 | Sute | G01S 5/04 |
| 10,228,444 | B2 | 3/2019 | Jonsson | |
| 10,306,419 | B2 | 5/2019 | Abou-Rizk et al. | |
| 10,324,158 | B2 | 6/2019 | Wang et al. | |
| 2015/0192656 | A1 | 7/2015 | Werner et al. | |
| 2017/0372261 | A1 * | 12/2017 | Bhatia | H04W 4/023 |
| 2018/0014151 | A1 | 1/2018 | Kratz et al. | |
| 2018/0056939 | A1 * | 3/2018 | van Roermund | B60R 25/24 |
| 2019/0200181 | A1 | 6/2019 | Abou-Rizk et al. | |

FOREIGN PATENT DOCUMENTS

| | | | |
|---|---|---|---|
| EP | 3147869 | A1 | 3/2017 |
| KR | 1365291 | B1 | 2/2014 |
| WO | 2016156231 | A1 | 10/2016 |
| WO | 2017068231 | A1 | 4/2017 |
| WO | 2018091660 | A1 | 5/2018 |
| WO | 2018191133 | A1 | 10/2018 |

* cited by examiner

CONTAINER AND ASSOCIATED METHODS

FOREIGN PRIORITY

This application claims priority to Indian Patent Application No. 201911034055, filed Aug. 23, 2019, and all the benefits accruing therefrom under 35 U.S.C. § 119, the contents of which in its entirety are herein incorporated by reference.

TECHNICAL FIELD OF INVENTION

The present invention relates generally to containers. More particularly, the invention relates to a container and a method for locking and unlocking said container.

BACKGROUND OF THE INVENTION

Various types of containers are used to store many different types of items. In some instances, these items need to be frequently removed and restored into the container. During this frequent removal and restoring process, sometimes some of the items may be misplaced and may not be stored back into the containers. This may lead to many problems.

For example, in the real estate industry, a key container is used by real estate agents to store keys of a property. During frequent visits by a real estate agent to a property for showcasing it to prospective customers, the real estate agent may misplace any key or forget to put the key back into the container. This may lead to the loss of the key.

Another example, in the hospitality, retail, and banking industries, various valuable items are frequently removed from and restored in safes (containers). In such industries, misplacing of any valuable item may cause a significant loss to the owner.

Thus, to prevent misplacing of items from a container such as keys in the former example and valuables in the later example, there is a need in the art for containers that can detect if an item is absent from within the container and alert a user of said absence.

In view of above-mentioned problem, a method and a system for locking and unlocking a container is needed.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

Aspects of the present invention relate to a container that comprises a communication module adapted to receive a first signal from a fob coupled to an item; and a measurement module, coupled with the communication module, the measurement module is adapted to measure a first angle-of-arrival based on the first signal received from the fob, and determine if the first angle of arrival is within a first pre-defined threshold range.

According to some aspects, the container comprises a locking module adapted to lock or unlock the container based on the determination of the measurement module.

According to some aspects, the locking module adapted to lock the container when the first angle of arrival is within the first pre-defined threshold range.

According to some aspects, the locking module adapted to not lock the container when the first angle of arrival is not within the first pre-defined threshold range.

According to some aspects, the locking module adapted to not unlock the container when the first angle of arrival is not within the first pre-defined threshold range.

According to some aspects, the communication module is adapted to receive a second signal from a user terminal, where the user terminal is located outside the container. Also, the measurement module is adapted to measure a second angle-of-arrival based on the second signal received from the user terminal and determine if the second angle of arrival is within a second pre-defined threshold range.

According to some aspects, the locking module is adapted to lock the container when first angle of arrival is within the first pre-defined threshold range and the second angle-of-arrival is within the second pre-defined threshold range.

According to some aspects, the measurement module is adapted to measure the second angle-of-arrival for signals received from the user terminal for a pre-defined threshold validation time and the locking module locks the container when the first angle of arrival is within the first pre-defined threshold range and the second angle-of-arrival is within the second pre-defined threshold range for the pre-defined threshold validation time.

According to some aspects, the communication module is adapted to send a first alert to a user terminal when the measurement module determines that the first angle-of-arrival is outside the first pre-defined threshold range or that the first signal is not received by the communication module, wherein the first alert indicates that the item is missing or the container is empty.

According to some aspects, the communication module is adapted to send a second alert to the user terminal when the measurement module determines that the second angle-of-arrival of the second signal is outside the second threshold range.

According to some aspects, the locking module unlocks the container when a third signal is received by the communication module from the user terminal.

According to some aspects, the measurement module is adapted to measure the angle of arrival of the third signal and the measurement module sets the second threshold range based on the angle of arrival of the third signal.

According to some aspects, the communication module is adapted to send a third alert to a user terminal when the angle of arrival of the first signal is within the first threshold range, wherein the third alert indicates to the user terminal the item is within the container.

According to some aspects, the communication module is adapted to send an alert to the user terminal with the second angle of arrival and the a state of the container when the measurement module determines that the second angle-of-arrival of the second signal is within the second threshold range.

Aspects of the present invention also relate to a method comprising the steps of receiving a first signal from a fob coupled to an item, measuring a first angle of arrival based on the first signal received from the fob, and determining if the first angle of arrival is within a first pre-defined threshold range.

According to some aspects, the method comprises the step of locking or unlocking the container when the first angle of arrival is within a first pre-defined threshold range.

According to some aspects, the method comprises the steps of receiving a second signal from a user terminal, the user terminal located outside a container, measuring a second angle-of-arrival based on the second signal received from the user terminal, and determining if the second angle of arrival is within a second pre-defined threshold range.

According to some aspects, the method comprises the steps of locking the container when first angle of arrival is within the first pre-defined threshold range and the second angle-of-arrival is within the second pre-defined threshold range.

Aspects of the present invention further relates to a computer readable medium comprising one or more processors and a memory coupled to the one or more processors, the memory storing instructions which are executed by the one or more processors, the one or more processors are configured to receive a first signal from a fob coupled to an item, measure a first angle of arrival based on the first signal received from the fob, determine if the first angle of arrival is within a first pre-defined threshold range, and lock or unlock the container when the first angle of arrival is within a first pre-defined threshold range.

According to some aspects, the one or more processors of the computer readable medium are configured to receive a second signal from a user terminal, the user terminal located outside a container, measure a second angle-of-arrival based on the second signal received from the user terminal, determine if the second angle of arrival is within a second pre-defined threshold range, and lock or unlock a container when the first angle of arrival is within a first pre-defined threshold range and the second angle of arrival (AOA) is within a second pre-defined threshold range.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

Some of the objects of the invention have been set forth above. These and other objects, features, aspects and advantages of the present invention will become better understood with regard to the following description, appended claims and accompanying drawings where:

FIG. 1A is a schematic diagram of the first embodiment, FIG. 1B illustrates a measurement of an angle of arrival of a signal from a fob, and FIG. 1C illustrates a measurement of an angle of arrival of a signal from a user terminal;

Corresponding reference numerals indicate corresponding parts throughout the drawings.

DETAILED DESCRIPTION OF THE INVENTION

The following detailed description should be read with reference to the drawings in which similar elements in different drawings are numbered the same. The drawings, which are not necessarily to scale, depict illustrative embodiments and are not intended to limit the scope of the invention. Although examples of construction, dimensions, and materials are illustrated for various elements, those skilled in the art will recognize that many of the examples provided have suitable alternatives that may be utilized.

Definitions

As used herein, the term "advertisement" refers to a digital signal being broadcasted by a wireless device within its range to notify other wireless devices of its presence.

Overview

Described herein is a container that comprises a communication module adapted to receive a first signal from a fob coupled to an item; and a measurement module, coupled with the communication module, the measurement module is adapted to measure a first angle-of-arrival based on the first signal received from the fob, and determine if the first angle of arrival is within a first pre-defined threshold range.

Also described herein is a method comprising the steps of receiving a first signal from a fob coupled to an item, measuring a first angle of arrival based on the first signal received from the fob, and determining if the first angle of arrival is within a first pre-defined threshold range.

Further described herein is a computer readable medium comprising one or more processors and a memory coupled to the one or more processors, the memory storing instructions which are executed by the one or more processors, the one or more processors are configured to receive a first signal from a fob coupled to an item, measure a first angle of arrival based on the first signal received from the fob, determine if the first angle of arrival is within a first pre-defined threshold range, and lock or unlock the container when the first angle of arrival is within a first pre-defined threshold range.

Description of Embodiments

Various different embodiments of the invention and the associated method are described below.

Figure 1A:
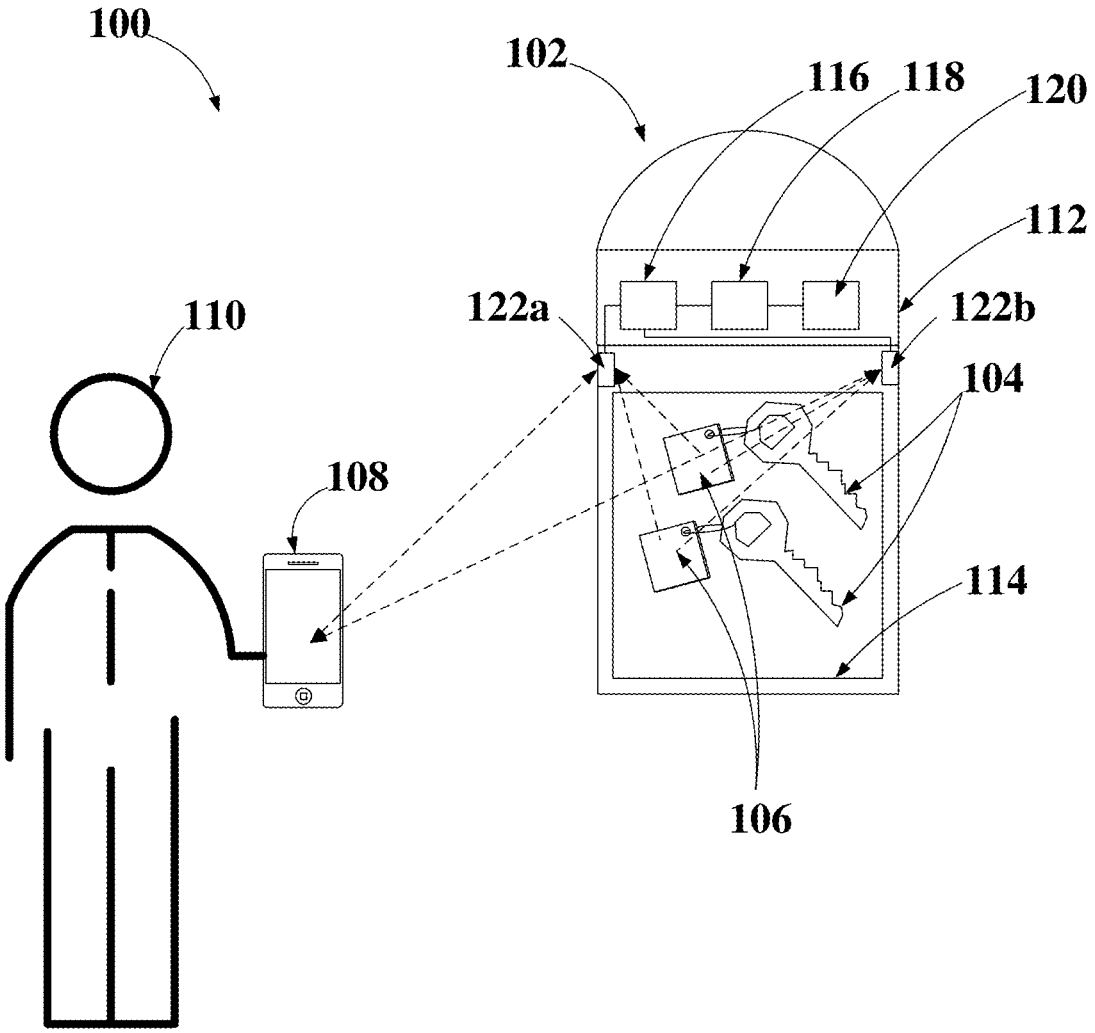
FIGS. 1A-1C is a schematic diagram illustrating an exemplary first embodiment of the invention, where

FIG. 1A depicts an exemplary system 100 comprising a container 102, items (keys) 104, fobs 106, a user terminal 108 and a user 110. The container 102 further includes a casing 112, a holder 114, a communication module 116, a measurement module 118, and a locking module 120. The communication module 116 is coupled to two or more antennae 122 (122*a*, 122*b*) for wireless communication with the fobs 106 and the user terminal 108. Also, the communication module 116, the measurement module 118, and the locking module 120 are operably connected with each other. In some embodiments, the container 102 also includes any type of energy storage device such as a battery to power its electrical and electronic components, for example, the communication module 116, the measurement module 118, and the locking module 120.

In some embodiments, each item 104 is paired to a fob 106. Each fob 106 includes a communication module that communicates with the container 102. In some embodiments, the fob 106 also includes an energy storage device, such as a battery to power its communication module, and is encased in an outer protective shell. The fob 106 can be of any shape or size based on its use and application and the shell of the fob 106 can be made of any strong and durable material, such as metal, metal alloys, plastics or wood.

In some embodiments, each fob 106 periodically transmits signals to the communication module 116 to indicate its presence, and consequently the presence of the corresponding item 104. In some embodiments, the signals of each fob 106 are short range communication signals, which can be sent via Bluetooth, Wi-Fi, Infrared, or Ultrasonic networks. In some embodiments, the signals are sent via Bluetooth Low Energy (BTLE) network standards to efficiently use energy storage devices. In such embodiments, the signals are BTLE advertisements.

In some embodiments, the user terminal 108 is a device that includes various input and output devices such as keyboards or touchscreens, and displays to allow the user 110 to send commands and receive alerts. Also, the user terminal 108 includes a communication module to communicate with the container 102 and an energy storage device, such as a battery to power the its electrical and electronic components. In some embodiments, the user terminal 108 is a device such as a mobile phone having a mobile application installed thereto to communicate with the container 102. In some other embodiments, the user terminal 108 is a custom-made device used only to communicate with the container 102, for example, a custom remote control for the container 102.

In some embodiments, the container 102 is adapted to hold the items 104 and fobs 106 within the holder 114, which can move in and out of the casing 112. The holder 114 and the casing 112 can be of any shape or size adapted to fit with each other and can be made of any strong and durable material, such as metal or metal alloys, plastics, etc.

The holder 114 can also be locked and unlocked within the casing 112. In some embodiments, the locking module 120 locks and unlocks the holder 114 within the casing 112 to prevent any unauthorized access to the items 104. The locking module 120 can include any locking mechanism that can be electrically actuated, known in the art, such as a solenoid actuated locking mechanism, a motor actuated locking mechanism, etc.

In some embodiments, the container 102 can have a 'slam-shut' style arrangement, where the holder 114 and the casing 112 gets locked when the keys (items 104) along with the fobs 106 are placed in the holder 114 and the holder 114 is placed in the casing 112.

In some other embodiments, the user 110 using the user terminal 108 can send instructions to the communication module 116 of the container 102, to lock or unlock the holder 114 within the casing 112 to access the items 104 when needed.

In some embodiments, the communication module 116 can also send alerts to the user terminal 108.

In some embodiments, the instruction and alerts are in the form of wireless signals, which can either be long-range or short-range communication signals. For example, long range communication signals (instructions) can be sent over via GSM, CDMA, 3G, 4G, 5G, or any other known long-range networks. Short-range communication signals can be sent via Bluetooth, Wi-Fi, Infrared, or Ultrasonic networks. The communication module 116 can be an electronic module capable of communicating said long range or short-range signals. In some embodiments, the instructions and alerts are sent via Bluetooth Low Energy (BTLE) network standards to conserve electrical energy. In these embodiments, the communication module is a Bluetooth communication module. In some embodiments, the instructions and alerts can be sent via BTLE advertisements.

Figure 1B:
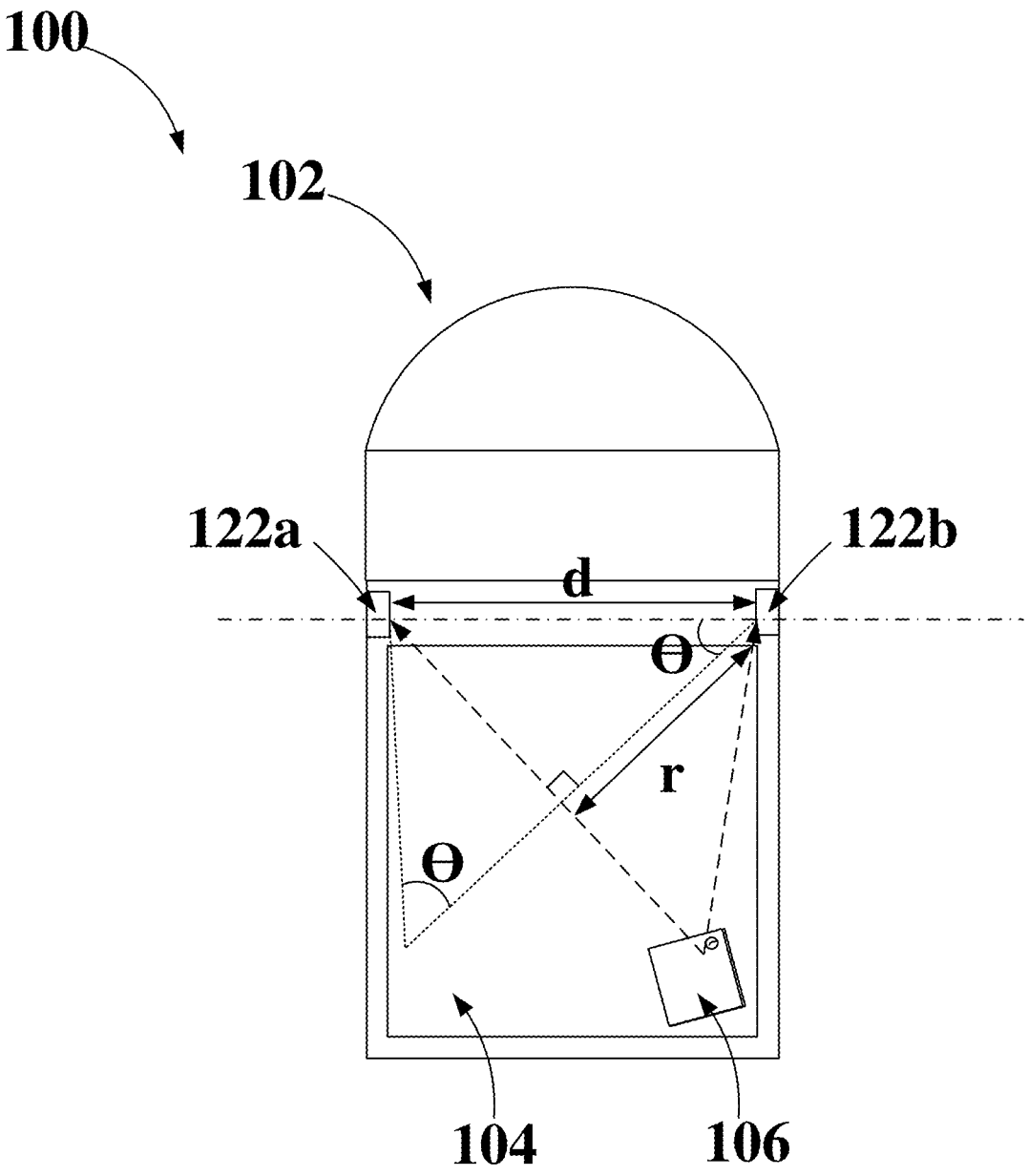

The measurement module 118 measures the angle of arrival of the signals received by the communication module 116 and sends any instructions received at the communication module 116 to the locking module 120. In some embodiments, the measurement module 118 is a standard micro-controller or microprocessor coupled with a memory comprising instructions to measure and calculate the angle of arrival (AOA) of the signals received from the fobs 106 and the user terminal 108. The measurement of angle of arrival FIG. 1B illustrates an exemplary measurement of an angle of arrival of a signal from a fob 106. As illustrated, the angle of arrival is calculated using two or more antennae, for example, in an embodiment an antenna 122*a* is positioned at one end of the container 102 and an antenna 122*b* is positioned at another end of the container 102, the distance between the two antennae 122*a* and 122*b* being attributed to the variable 'd'. The angle of arrival of a signal from the fob 106 will be governed by the below equations:

$$r=\lambda\phi/2\pi \quad (1)$$

$$r=d\sin(\theta) \quad (2)$$

$$\sin(\theta)=r/d \quad (3)$$

where, Φ represents the phase shift in the signal received by the two antennae 122*a* and 122*b*, and Θ is the angle of arrival of the signal from the fob 106.

Figure 1C:
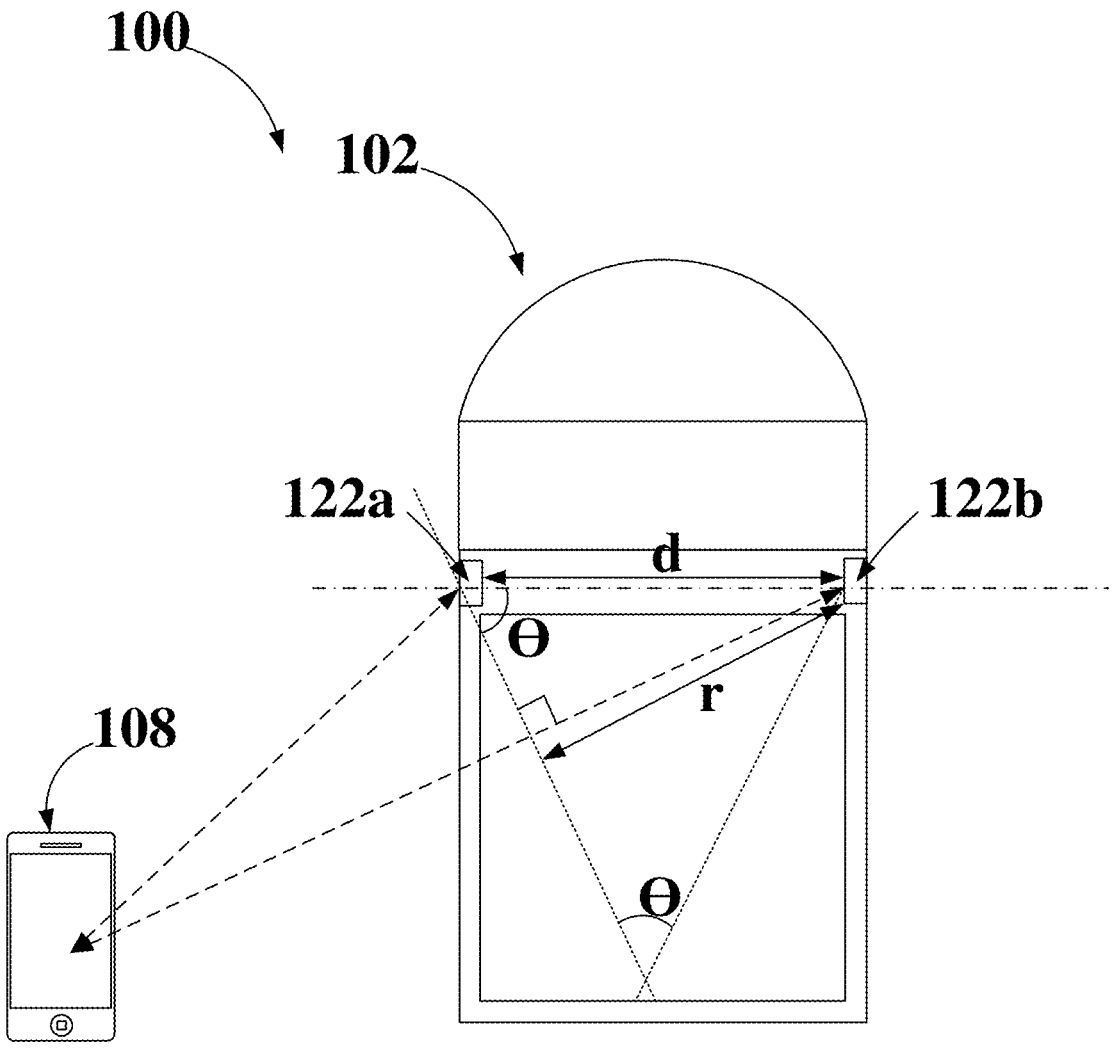

Similarly, FIG. 1C illustrates an exemplary measurement of angle of arrival Θ of signal from the user terminal 108. As discussed above, the angle of arrival of the signal from the user terminal 108 is calculated by measuring the phase shift of the signal received by the two antennae 122*a* and 122*b* and the distance between the antennae 122*a* and 122*b* and using the equations (1), (2), and (3).

Although the above FIGS. 1B and 1C illustrate the calculation of the angle of arrival in two dimensions, the same principles are applicable in measurement of angle of arrival in three-dimensional space. For example, assuming the space is defined by three dimensions x, y, and z, calculation of angles of arrival with respect to xy, yz, and xz planes for an object (for example, fob 106 or user terminal 108) placed in three dimensional space can be calculated as a representation of the position of the object within the three dimensional space.

Further, it can be identified that the fob 106 is present within the container 102 by comparing the angle of arrival of signal received from the fob 106 by the antennae 122*a* and 122*b* with a first threshold range of angle of arrival values, where the first threshold range includes all possible values of angle of arrival that can be associated with the space within the container 102. The said first threshold range can be stored within a memory associated with the measurement device 118. The first threshold range is dependent on the size and shape of the container 102 and may vary in accordance with the change in size or shape of the container 102.

Similarly, it can be identified that the user terminal 108 is present within a certain specified range of distance from the container, for example, within a radius of 3 meters, etc. by comparing the angle of arrival of signal received from the user terminal 108 with a second threshold range of angle of arrival values, where the second threshold range includes all possible values of angle of arrival that can be associated with the space within the specified range of distance around the container 102. The second threshold range can be stored within a memory associated with the measurement device 118. The second threshold range may be dependent on the signal strength of the signals originating from the user terminal 108 or the signal sensitivity of the antennae 122*a* and 122*b* and may vary in accordance with the change in said quantities.

In some embodiments, the container 102 has indicators such as a visual indicator (such as LEDs) or audio indicators (such as speakers) or haptic indicator (such as a vibration motor) that indicate various events to the user 110, such as, an LED light positioned on the casing may turn from red to green when the container 102 is locked, or when an item 104 is missing from the container 102, an audio alarm may sound or the casing 112 may vibrate to alert the user. The container 102 may also send alerts to the user terminal 108 indicating that the item 104 is missing from the container 102.

Figure 2:
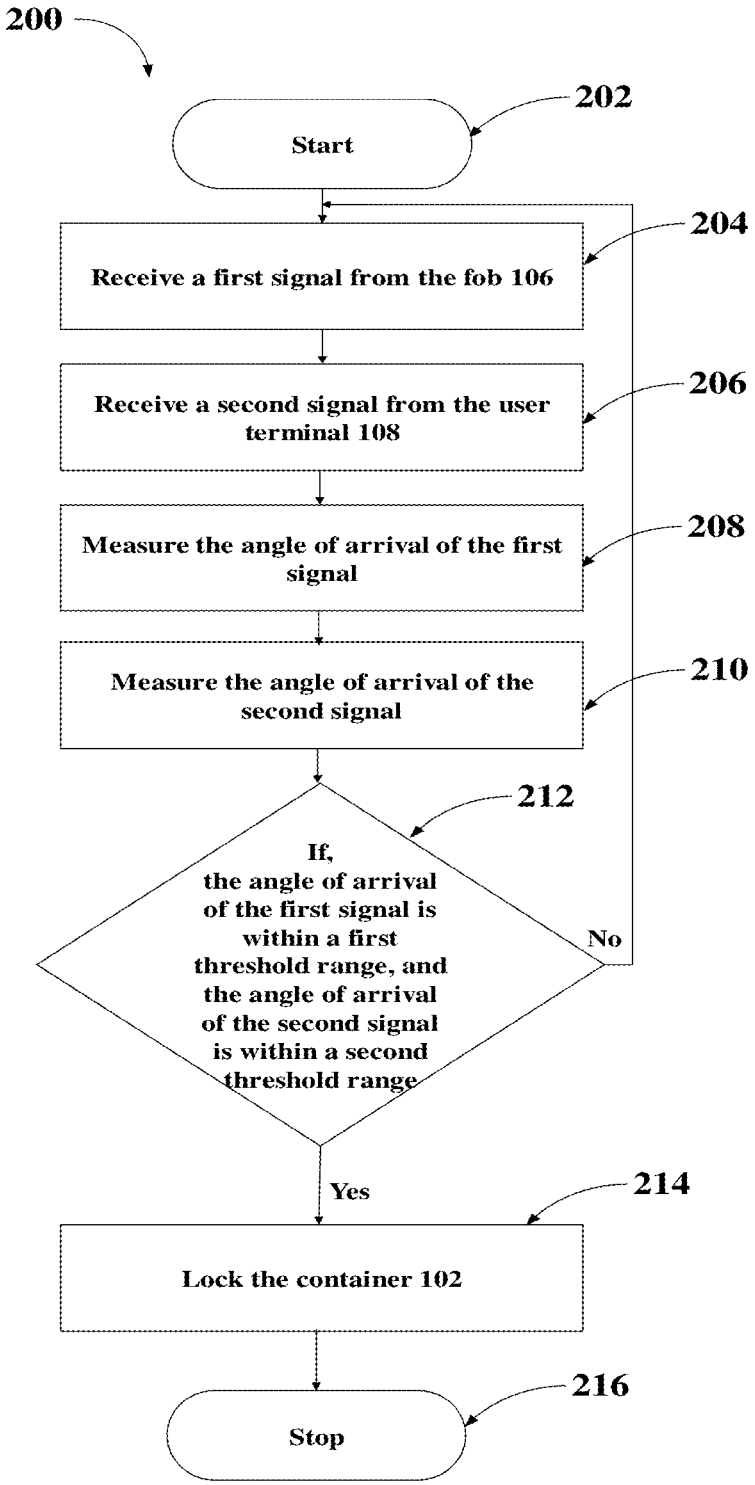
FIG. 2 is a flow chart illustrating a method of operation of the invention.

FIG. 2 is a flowchart 200 depicting an exemplary method of functioning of the container 102. In many instances, the user 110 may misplace an item 104 or forget to put an item 104 back within the container 102 To prevent this condition, the container 102 can be configured to only get locked when the fob 106 attached to the item 104 is present in the container 102. To implement this conditional locking, the following steps are performed. The method flowchart 200 starts at step 202.

In a step 204, the communication module 116 receives a first signal from the fob 106 placed within the container 102. In some embodiments, the first signal may be a BTLE advertisement broadcasted by the fob 106.

In a step 206, the communication module 116 receives a second signal from the user terminal 108. In some embodiments, the second signal may be a locking instructions communicated by the user terminal 108 to the container 102. Alternatively, the second signal can be a BTLE advertisement broadcasted by the user terminal 108.

In a step 208, the measurement module 118 measures the angle of arrival (AOA) of the first signal.

In a step 210, the measurement module 118 measures angle of arrival (AOA) of the second signal.

In a step 212, the measurement module 118 identifies if the angle of arrival (AOA) of the first signal is within a first threshold range and if the angle of arrival (AOA) of the second signal is within a second threshold range. The first threshold range can be selected from a group of AOA for the first signal that indicates that the key fob 106 is within the casing 112. The second threshold range can be selected from a group of AOA for the second signals that indicate that the user terminal 108 is within a specified range (set of locations) with respect to the communication module 116, and consequently the container 102.

In a step 214, if the conditions of step 212 are true, the measurement module 118 sends instructions to the locking module 120 to lock the holder 114 within the casing 112, thereby locking the container 102.

The method flowchart ends at a step 216 after performing step 214.

Alternatively, if the conditions of step 212 are false, the above steps are repeated in a loop.

The method described by the above steps allows the locking of the container 102 only when the fob 106 is present within the container 102 and when the user terminal 108 is within a specified range (set of locations) relative to the container 102. As an example of one of the various embodiments, if a real estate agent forgets to put keys (items 104) attached to the fob 106 back in the container 102 and attempts to lock the container 102 by sending an instruction to lock the container 102 (an example of second signal) via the user terminal 108, the container 102 will not get locked. The container will only get locked if the real estate agent puts the keys (items 104) along with the fob 106 into the container 102 and then sends the instruction to lock the container 102 or when the user terminal 108 comes within a specified range of distance of the container 102. This conditional locking of the container 102 make the real estate agent aware of the situation, in case, the keys (items 104) are missing from the container 102. Further, visual or auditory or haptic feedback may be provided to the real estate agent by the container 102 to indicate that the keys (items 104) are missing. Furthermore, the container 102 may also send alerts to the user terminal 108 indicating that the item 104 is missing from the container 102.

The method can include additional steps, for example, in some embodiments, the measurement module 118 sends via the communication module 116, a first alert to the user terminal 108 when the angle of arrival (AOA) of the first signal received from the fob 106 is outside the first threshold range or when the first signal is not received by the communication module 116. The first alert indicates to the user terminal 108 that an item 104 (corresponding fob 106) is missing or the container 102 is empty. In such embodiments, the measurement module 118 may further instruct the locking module 120 to not lock the container 102 to conserve battery of the container 102.

In some embodiments, the measurement module 118 sends via the communication module 116, a second alert to the user terminal 108 when the angle of arrival (AOA) of the second signal received from the user terminal 108 is outside the second threshold range. The second alert informs the user terminal 108 that it is outside the range for locking the container 102.

In some other embodiments, if the user terminal 108 is positioned relative to the container 102 such that the angle of arrival of the second signal falls within the second threshold range, then the communication module 116 sends an alert to the user terminal 108 indicating the state of the container 102, i.e. the presence or absence the fob 106 within the container 102, the open or closed state of the holder 114 within the casing 112, and the locked or unlocked state of the locking module 120. In some embodiments, the communication module 116 also sends the measured angle of arrival of the signal received from the user terminal 108 to the user terminal 108.

In some embodiments, the measurement module 118 instructs the locking module 120 to unlock the container 102 when a third signal (unlock instructions) is received by the communication module 116 from the user terminal 108. In such embodiments, the measurement module 118 may instruct the locking module 120 to not unlock the container 102 if the first signal is not received from the fob 106 or the angle of arrival of the signal received from the fob 106 indicates that the fob 106 is outside the container 102. This step may be performed to conserve battery of the container 102. In addition, the measurement module 118 via the communication module 116 may send an alert to the user terminal 108 to inform the user 110 that the container 102 is empty.

In some embodiments, the measurement module 118 measures the angle of arrival of the third signal and sets the second threshold range based on the angle of arrival (AOA) of the third signal. In these embodiments, while subsequent locking of the container 102, the user has to bring the user terminal 108 at approximately the same location with respect to the container 102, where it was used to open the container 102. This feature enhances the security of the container 102.

In some embodiments, the measurement module 118 via the communication module 116 sends a third alert to the user terminal 108 when the angle of arrival (AOA) of the first signal is within the first threshold range and when the angle of arrival (AOA) of the second signal is within the second threshold range. The third alert indicates to the user terminal 108, the number of fobs 106 that are within the first threshold range. This alert can inform the user about the number of fobs 106 and therefore the number of keys 104 within the container 102.

In some embodiments, the measurement module 118 via the locking module 120 may flip the locked or unlocked state of the container 102 if the first angle of arrival is within the first pre-defined threshold range and the second angle of arrival is within the second pre-defined threshold range. This may enable ease of use of the container for the user 110. For example, if all the fobs 106 are within the container and the user 110 brings the user device 108 in proximity to the container 102, the container may get automatically locked or unlocked based on its previous state.

In some embodiments, the measurement module 118 may validate the credentials of the user 110 by requesting user credentials from the user terminal 108 before executing any signals/instructions received from the user terminal 108 and measuring the angle of arrival of said signals/instructions for a specified access validation time. If the user credentials received from the user terminal 108 match the user credentials stored in a memory associated with the measurement module 118 and the signals/instructions are received for the specified access validation time and the angle of arrivals of said signals/instructions are within the second pre-defined threshold, then the measurement module may execute instructions received from the user terminal 108, else the measurement module may send an alert to the user terminal 108 indicating user credential validation failure.

In some embodiments, the measurement module 118 may also measure the time taken for user credential validation and may not execute any instructions received from the user terminal 118 if the validation time is not within a pre-defined threshold. Further, the user 110 may be alerted to be present at a certain position having an angle of arrival within a specified range for a pre-defined threshold of time to lock or unlock the container 102.

In some embodiments, the user terminal 108 may include a geographical positioning system, such as a GPS system. In such embodiments, the user terminal 108 may acquire the geographical location of the user terminal 108 using the geographical positioning system and transmit a location signal comprising the geographical location information to the container 102. The communication module 116 may receive the location signal and the measurement module 118 may measure the angle of arrival of the location signal and calculate the location of the container 102 based on the angle of arrival of the location signal and the geographical information contained in the location signal. In such embodiments, the measurement module 118 may instruct the container 102 to not lock or unlock the container 102, if the container 102 is not within a pre-specified geographical location.

Alternative steps to some of the above methods can also be contemplated by a person skilled in the art. For example, in some embodiments, the container 102 can have a 'slam-shut' style arrangement, as described above, where no signal from the user terminal 108 is needed to lock the container 102. The method may include only the steps of receiving and measuring the angle of arrival (AOA) of the first signal, and locking the container if the angle of arrival of the first signal is within the first pre-defined range.

Other alternatives and variations of a method to operate the container 102 can also be contemplated by a person skilled in the art.

Although the above method steps have been described in a sequence, there may be other embodiments of the invention that may have different sequences of performing aforesaid steps or may perform some of the steps in parallel. For example, the measurement module 118 may send multiple alerts to the user terminal 108 in parallel, such as, in case, there were five fobs 106 and one is missing, both the first alert for a missing fob 106 and the third alert for the presence of four fobs 106 can be sent.

Figure 3:
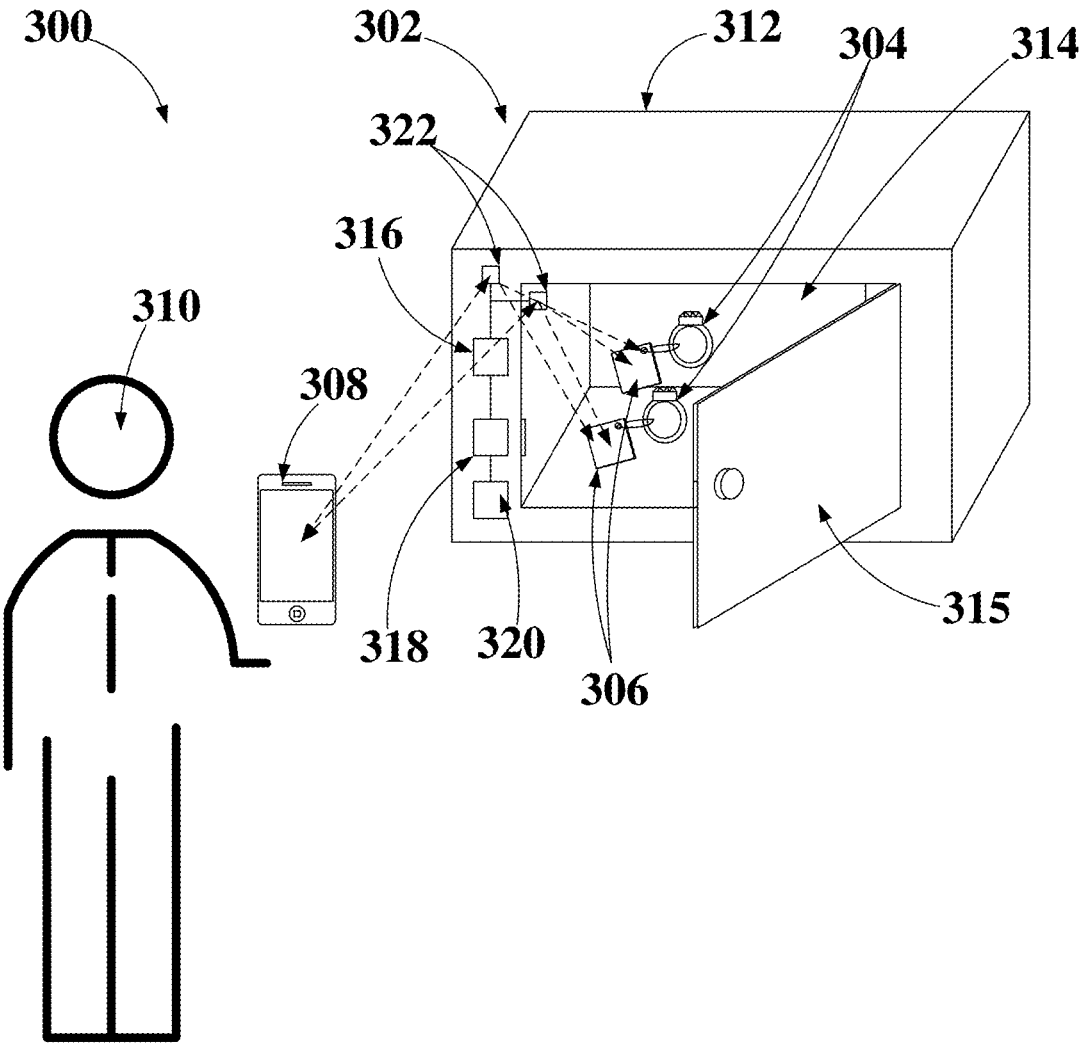
FIG. 3 schematic diagram illustrating a second exemplary embodiment of the invention.

FIG. 3 depicts an alternate embodiment of the invention. As depicted, a system 300 comprising a container 302, items (for example, jewelry) 304, fobs 306, a user terminal 308 and a user 310. The container 302 further includes a shell 312, a cavity 314, a door 315 for accessing the cavity, a communication module 316, a measurement module 318, and a locking module 320. The communication module 316 is coupled to antennae 322 for wireless communication with the fobs 306 and the user terminal 308. Also, the communication module 316, the measurement module 318, and the locking module 320 are operably connected with each other.

The functioning and method for locking and unlocking of the container 302 of the system 300 is identical to the method of conditional locking and unlocking of the container 100 of the first embodiment and hence is not discussed in detail herein.

In some embodiments, this embodiment can be implemented in lockers in schools, hotels, apartment complexes, post offices, etc. For example, an embodiment of the invention can be a safe or locker present within a hotel room, which a guest can use for securely storing her valuables during her stay in the hotel room.

In some other embodiments of the invention, the container can be a room within a building or any enclosed structure, for example, a hotel room, a lecture hall, a factory workshop, a shopping center, a storage facility etc., and items can be any of goods coupled with the fobs or people carrying the fobs with them. The room can have an access door that can be locked and unlocked via the user terminal. In such embodiments, the communication module, measurement module, and the locking module can be positioned anywhere within the room. The invention can be used to control and monitor the access of goods and people within the room. For example, an embodiment of the invention can be implemented in a lecture hall to mark attendance of students within the lecture hall, where each student carries a fob (or alternatively a mobile phone acting as a fob) with them. Also, the lecture hall door can be locked or unlocked by a teacher carrying the user terminal (also can be a mobile phone).

In yet some other embodiments, the invention can be implemented in shipping containers, cargo holds in ships, trains, and airplanes, etc. With reference to FIG. 1, in some embodiment of the invention, the invention can be operated using the one or more computer readable devices. The one or more computer readable devices can be associated with the measurement module 118. A computer readable medium comprising one or more processors and a memory coupled to the one or more processors, the memory storing instructions which are executed by the one or more processors, the one or more processors configured to receive a first signal from a fob 106 coupled to an item 104 and a second signal from a user terminal 108, the user terminal 108 located outside a container 102. In addition, the memory stores instructions to measure a first angle of arrival based on the first signal received from the fob 106 and a second angle-of-arrival based on the second signal received from the user terminal 108. Further, the memory stores instructions to lock the container 102 when the first angle of arrival is within a first pre-defined threshold range and the second angle of arrival (AOA) is within a second pre-defined threshold range.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purposes or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures/Tables and described herein. Other examples of the invention may include different computer-executable instructions or components having more or less functionality than illustrated and described herein.

Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," "cache," and substantially any other information storage component relevant to operation and functionality of a component, refer to "memory components," or entities embodied in a "memory" or components comprising the memory. It will be appreciated that the memory components, or computer-readable storage media, described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Furthermore, the terms "user," "real estate agent," and the like are employed interchangeably throughout the subject specification, unless context warrants particular distinction (s) among the terms. Such terms can refer to human entities and so forth that can operate the user terminals 108, 308 of the systems 100, 300 disclosed herein.

Moreover, the terms "container," "key box," "safe" and the like are employed interchangeably throughout the subject specification, unless context warrants particular distinction(s) among the terms. Such terms can refer to the containers 102, 302 and the like as disclosed herein.

The present invention is applicable to various fields such as, but is not limited to, hospitality applications, real estate, hospitality, retail, logistics services, and any such field that is obvious to a person skilled in the art.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C".

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A container adapted to receive a first signal from a fob coupled to an item, the container comprising:

a measurement module, adapted to:

measure a first angle-of-arrival based on the first signal received from the fob, and determine if the first angle of arrival is within a first pre-defined threshold range;

wherein the container is adapted to receive a second signal from a user terminal, the user terminal located outside the container, and the measurement module is adapted to measure a second angle-of-arrival based on the second signal received from the user terminal and determine if the second angle of arrival is within a second pre-defined threshold range; and locking or unlocking the container when the first angle of arrival is within a first pre-defined threshold range.

2. The container of claim 1 comprising a locking module adapted to lock or unlock the container based on the determination of the measurement module.

3. The container of claim 2, wherein the locking module adapted to lock the container when the first angle of arrival is within the first pre-defined threshold range.

4. The container of claim 2, wherein the locking module adapted to not lock the container when the first angle of arrival is not within the first pre-defined threshold range.

5. The container of claim 2, wherein the locking module adapted to not unlock the container when the first angle of arrival is not within the first pre-defined threshold range.

6. The container of claim 1, wherein the locking module is adapted to lock the container when first angle of arrival is within the first pre-defined threshold range and the second angle-of-arrival is within the second pre-defined threshold range.

7. The container of claim 1, wherein the measurement module is adapted to measures the second angle-of-arrival for signals received from the user terminal for a pre-defined threshold validation time and the locking module is adapted to lock the container when the first angle of arrival is within the first pre-defined threshold range and the second angle-of-arrival is within the second pre-defined threshold range for the pre-defined threshold validation time.

8. The container of claim 1, wherein the container is adapted to send a second alert to the user terminal when the measurement module determines that the second angle-of-arrival of the second signal is outside the second threshold range.

9. The container of claim 1, wherein the locking module is adapted to unlock the container when a third signal is received from the user terminal.

10. The container of claim 9, wherein the measurement module is adapted to measure the angle of arrival of the third signal and the measurement module sets the second threshold range based on the angle of arrival of the third signal.

11. The container of claim 1, wherein the container is adapted to send an alert to the user terminal with the second angle of arrival and a state of the container when the measurement module determines that the second angle-of-arrival of the second signal is within the second threshold range.

12. A method comprising:

receiving a first signal from a fob coupled to an item;

measuring a first angle of arrival based on the first signal received from the fob; and determining if the first angle of arrival is within a first pre-defined threshold range;

receiving a second signal from a user terminal, the user terminal located outside a container;

measuring a second angle-of-arrival based on the second signal received from the user terminal;

determining if the second angle of arrival is within a second pre-defined threshold range;

locking or unlocking the container when the first angle of arrival is within a first pre-defined threshold range.

13. The method of claim 12 comprising locking the container when first angle of arrival is within the first pre-defined threshold range and the second angle-of-arrival is within the second pre-defined threshold range.

14. A non-transitory computer readable medium comprising one or more processors and a memory coupled to the one or more processors, the memory storing instructions which are executed by the one or more processors, the one or more processors configured to:

receive a first signal from a fob coupled to an item;

measure a first angle of arrival based on the first signal received from the fob;

determine if the first angle of arrival is within a first pre-defined threshold range; and receive a second signal from a user terminal, the user terminal located outside a container;

measure a second angle-of-arrival based on the second signal received from the user terminal;

determine if the second angle of arrival is within a second pre-defined threshold range; and lock or unlock a container when the first angle of arrival is within a first pre-defined threshold range and the second angle of arrival (AOA) is within a second pre-defined threshold range.

* * * * *